United States Patent [19]

King et al.

[11] 4,239,535

[45] Dec. 16, 1980

[54] MAGNESIUM ALLOYS

[76] Inventors: John F. King, 19 Brookside Crescent, Greenmount, Bury; William Unsworth, 2 Ilkeston Dr., Aspull, Wigan, Lancs., both of England

[21] Appl. No.: 44,272

[22] Filed: May 31, 1979

[30] Foreign Application Priority Data

May 31, 1978 [GB] United Kingdom ..... 24941/78

[51] Int. Cl.[3] ..... C22F 1/06

[52] U.S. Cl. ..... 75/168 D; 75/168 E; 75/168 F; 75/168 J; 148/32.5; 148/161

[58] Field of Search ..... 75/168 C, 168 D, 168 E, 75/168 F, 168 G, 168 J, 168 M; 148/161, 32.5

[56] References Cited

U.S. PATENT DOCUMENTS

| | | | |
|---|---|---|---|
| 3,039,868 | 6/1962 | Payne | 75/168 |
| 3,404,048 | 10/1968 | Stratford | 148/161 |
| 3,469,974 | 9/1969 | Ziegler et al. | 75/168 |
| 3,892,565 | 7/1975 | Foerster et al. | 75/168 C |
| 4,116,731 | 9/1978 | Tikhova | 148/161 |

FOREIGN PATENT DOCUMENTS

| | | | |
|---|---|---|---|
| 1179008 | 10/1964 | Fed. Rep. of Germany | 75/168 |
| 1423127 | 1/1976 | United Kingdom . | |
| 1452671 | 10/1976 | United Kingdom . | |

*Primary Examiner*—L. Dewayne Rutledge
*Assistant Examiner*—Upendra Roy
*Attorney, Agent, or Firm*—Karl W. Flocks

[57] ABSTRACT

A magnesium alloy for casting contains from 2 to 10% of zinc and from 0.5 to 5% of copper as essential constituents, aluminium being substantially absent. The alloy as cast has a fine grain size, making a grain refinement step unnecessary and has favorable mechanical properties, especially after heat treatment. Other constituents such as up to 2% manganese can be added to improve particular properties.

9 Claims, 2 Drawing Figures

EFFECT OF Cu IN Mg-Zn-Cu ALLOYS ON SOLIDUS TEMPERATURE

EFFECT OF Cu IN Mg-Zn-Cu ALLOYS ON SOLIDUS TEMPERATURE

EFFECT OF Cu IN Mg-6% Zn ALLOY ON TENSILE PROPERTIES

MAGNESIUM ALLOYS

This invention relates to magnesium alloys.

There are known many magnesium alloys containing constituents intended to improve their mechanical properties. However these alloys generally require a grain refining step before casting in order to achieve optimum properties. Grain refining can be carried out in a number of ways, for example superheating to about 900° C. in an iron vessel before casting, inoculation with small amounts of iron (for example by addition of ferric chloride), inoculation with carbon (for example by treatment with hexachloroethane) and by addition of grain refining alloying elements such as zirconium and titanium. All these methods increase the cost of cast articles made from the alloy. Superheating and inoculation with carbon or iron introduce an additional step during casting, are generally troublesome in practice and can be dangerous if rigorous precautions are not observed. Additives such as zirconium and titanium are expensive, whether they are added as constituents of hardener alloys or as pure metal.

One known magnesium alloy, "AZ91", contains about 9% aluminium and b 1% zinc as the major alloy additives and is capable of giving a minimum yield strength of 95 N/mm$^2$, minimum ultimate tensile strength of 125 N/mm$^2$ and an elongation of ½–2% in the as-cast state. The corresponding minimum values obtained after high-temperature solution heat treatment, quenching and ageing are yield stress 120 N/mm$^2$, ultimate tensile strength 200 N/mm$^2$ and elongation ½–2%. However this alloy requires grain refining, has relatively low ductility and is prone to microporosity when sand or die-cast.

Other magnesium alloys developed by NL Industries Inc. and the subject of British Pat. Nos. 1,423,127 and 1,452,671 contain zinc with aluminium. These alloys are designed for die-casting but are unsatisfactory when sand-cast.

It is an object of the present invention to provide a magnesium alloy which is capable of providing good mechanical properties, at least as good as those of AZ91, but at lower cost and with casting behaviour both as sand-cast and die-cast, at least as good as those mentioned above.

According to the invention there is provided an alloy comprising, apart from impurities, from 2 to 10% by weight of zinc and from 0.5% to 5% copper, the remainder being magnesium.

Other elements may be added to improve the properties of the alloy obtained. Thus up to 2% of manganese (preferably 0.2–1% manganese) may be added to improve the yield strength of the alloy and also improve the resistance to corrosion, particularly that of the heat-treated alloy. The resistance to corrosion may also be improved by the addition of up to 3% bismuth and/or up to 1% of antimony. Up to 5% of cadmium may be added to improve the casting behaviour of the alloy. The addition of up to 1% of silicon and/or up to 1% of rare earth metals (preferably a mixture of rare earth metals containing a high proportion of neodymium and little lanthanum or cerium) may improve the creep and high-temperature mechanical properties of the alloy. Up to 2% of tin may also be added.

It should be noted that grain refining elements such as zirconium and titanium are not required and aluminium should be substantially absent.

It has been found that the grain size obtained on casting the alloys of the invention without grain refining treatment is sufficiently small to give satisfactory properties and thus no grain refining step is necessary. Similar magnesium/zinc alloys containing no copper are known to be coarse grained, have poor mechanical properties and are prone to microporosity and hot cracking or tearing when cast.

It has been found that optimum properties are obtained with a zinc content from 5 to 7% and a copper content from 1 to 3.5%.

The alloys of the invention can be cast in a number of ways, including sand casting and die casting. The sand casting properties have been found to be superior to those of comparable alloys, especially with regard to microporosity. It has been found that least porosity occurs with about 6% Zn and 2–3% Cu in the alloys of the invention.

Heat treatment of the cast alloys is generally necessary to obtain optimum mechanical properties. This heat treatment comprises solution heat treatment, preferably at the highest practicable temperature (e.g. about 20° C. below the solidus of the alloy) followed by quenching and ageing. Quenching in hot water followed by ageing at about 180° C. have been found satisfactory.

It should be noted that the addition of copper to magnesium alloys containing zinc gives an increase in the solidus temperature and hence in the possible temperature of solution heat treatment. The effect on the solidus temperature for magnesium alloys containing 6, 8 and 10% zinc of increasing amounts of copper is shown in FIG. 1. The increased solidus is an important factor in obtaining high mechanical properties on heat treatment. Solution heat treatment at lower temperatures (for example 330° C.) has been found much less effective in improving mechanical properties.

Preferred heat treatment and conditions are solution treatment at from 5° to 40° C. below the solidus for 2 to 8 hours, followed by quenching and ageing at from 120° to 250° C. for at least 2 hours.

A suitable heat treatment procedure comprises solution heat treatment at a temperature about 20° C. less than the solidus for about 4–8 hours, and water quenching and ageing for 24 hours at 180° C.

It has been found, surprisingly, that the rate of corrosion in salt water of the heat-treated alloys of the invention is much less than that of the as-cast alloy. This difference is the reverse of that experienced with comparable alloys, such as those containing zinc and aluminium, in which corrosion is increased by heat treatment. It has been found that addition of manganese, for example in an amount of 0.2–1.0% gives a particularly low corrosion rate. Addition of bismuth and/or antimony has a further beneficial effect.

The alloys of the invention also show much better welding behaviour than similar alloys which do not contain copper.

Alloys according to the invention will be described in the following Examples.

In the accompanying drawings.

EXAMPLE 1

Figure 1:
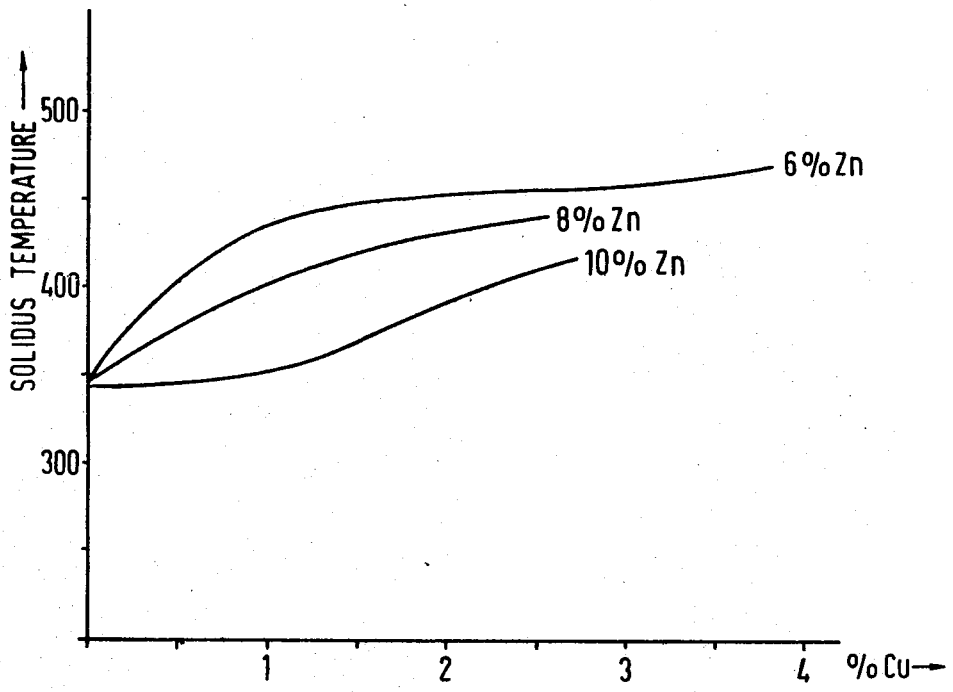
FIG. 1 shows the effect on the solidus temperature of copper additions to magnesium/zinc alloys.

Magnesium alloys having the constituents given in Table 1 below were made by melting magnesium, raising its temperature to 780° C., adding the constituents listed, stirring then subjecting the melt to a grain refinement process in which ferric chloride was injected into the melt in a suitable form to react with the magnesium alloy to form iron rich nuclei. The alloys were sand cast at 780° C. to form standard test bars. (In the case of alloy 14, no grain refinement process was carried out).

The cast bars were machined to tensile specimens and were tested in the as-cast state by methods in accordance with British Standard No. 18. Further bars were solution heat treated at the temperatures given in Table 1, hot water quenched, aged for 24 hours at 180° C., then machined to tensile test specimens and tested in accordance with British Standard No. 18.

The solidus temperature of the alloys, and grain size obtained were measured by established methods.

The results obtained are given in Table 1. In the Table, Y.S. indicates 0.2% proof stress, U.T.S., ultimate tensile strength and E%, elongation at fracture. Alloys A-E are comparative alloys, not within the invention. Minimum tensile properties for a comparative alloy AZ91, as specified in British Standard 3L125 are also shown.

It will be appreciated from these results that although the alloys of the invention gave a low yield stress in the as-cast state, the ultimate tensile strength and elongation for all alloys in the claimed range were substantially better than the specified minima for the comparative alloy AZ91. After heat treatment, all alloys with copper additions within the claimed range showed an unexpectedly large increase in yield stress, compared to the as-cast value. Tensile properties were also found to be highly dependent on the relative levels of Zn and Cu. Increasing Zn increased the yield stress of alloys, but reduced the U.T.S. and elongation particularly beyond 8%, whilst yield stress and U.T.S. passed through a maximum around 1½% Cu, although elongation continued to improve with increasing Cu. This is more clearly demonstrated by reference to the vertically hatched bands in FIG. 2 which shows the effect of increasing Cu content on tensile properties of a large number of alloys containing 6% Zn.

The grain size of alloy 14 in Table 1 was well within the range of grain sizes obtained from the other alloys listed, although alloy 14 was not subjected to a specific grain refining treatment. Since the grain size of all the alloys were substantially finer than that which would be obtained from a Mg-Zn binary alloy, without grain refinement, this demonstrates the grain refining effect of the copper addition.

The mechanical properties of the comparison alloys were generally less than the specified minima, especially after heat treatment.

EXAMPLE 2

Magnesium alloys were made, cast and tested as in Example 1. Test samples were subjected to different heat treatments set out in Table 2 below. Some of the alloys contained the indicated quantities of manganese, tin or antimony.

It will be noted that high-temperature solution heat treatment, followed by quenching and ageing, is required to give optimum mechanical properties. Heat treatment at a lower temperature, and heat treatment without quenching and ageing, produce some improvement in properties but these properties fall short of the optimum.

EXAMPLE 3

The addition of manganese to alloys containing Mg-Zn-Cu was found to be particularly beneficial on both tensile properties and corrosion resistance of the alloys. The former is demonstrated by the following trial:

A number of magnesium alloys containing various levels of Zn, Cu and Mn were cast in the form of sand cast test bars, using the techniques described in Example 1, except that some were subjected to a grain refinement process, while others were given no specific grain refining treatment. Compositions and grain refinement treatments are shown in Table 3. Cast test bars were solution heat treated at the temperatures in the table, hot water quenched, then aged for 24 hours at 180° C. Tensile test speciments were machined from the heat treated bars and tensile tested in accordance with British Standard 18. Tensile results are shown in Table 3, in comparison with equivalent Mg-Zn-Cu alloys without Mn addition.

It may be seen that in all cases, addition of Mn resulted in a significant improvement in Yield strength, although some reduction in U.T.S. and ductility resulted. Ductility was, however, still higher than that recommended as a minimum for the comparative alloy AZ91 in British Standard 3L125.

Figure 2:
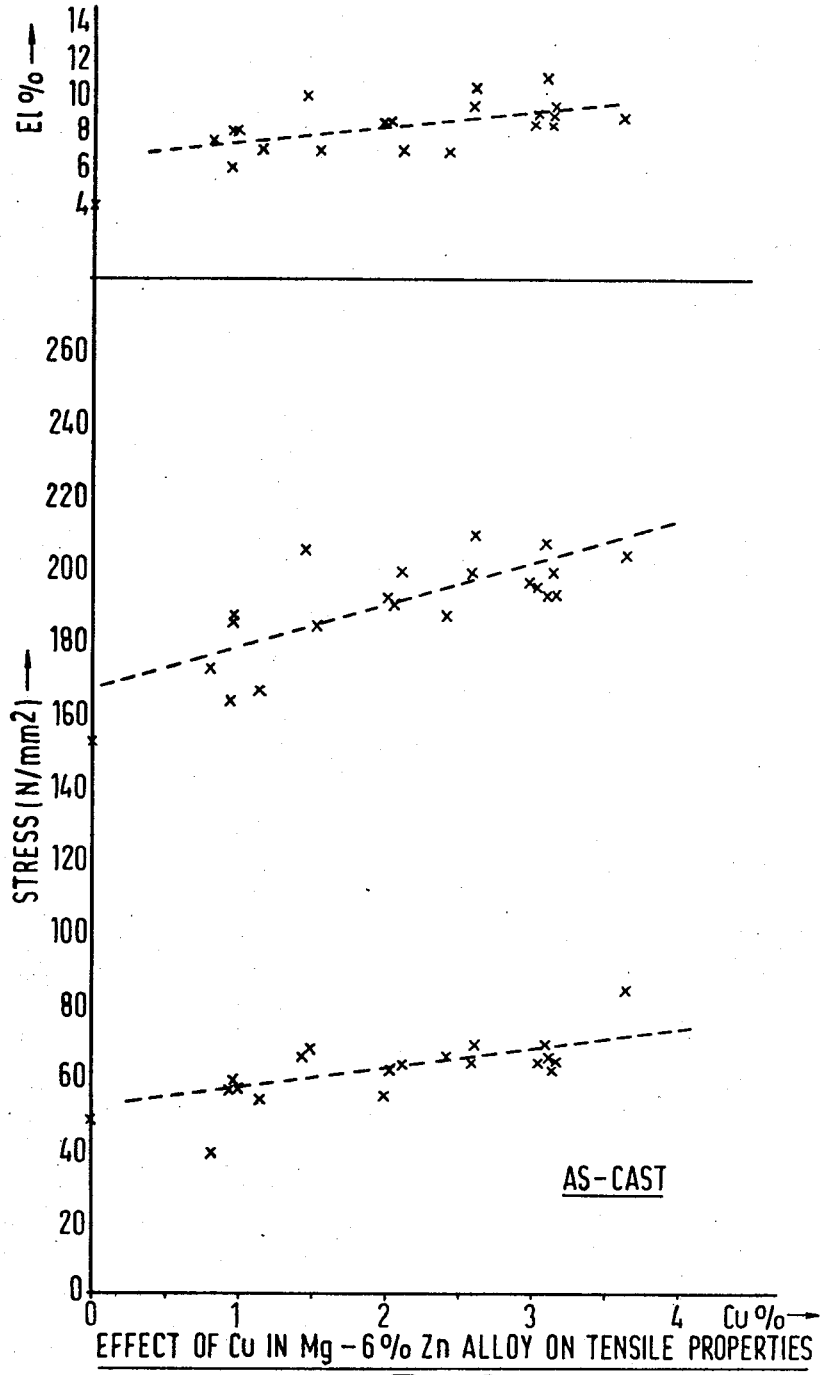
FIG. 2 shows the effect of copper additions to a magnesium/6% zinc alloy, with and without manganese, on the tensile properties of the alloy.

The beneficial effect of Mn on Yield strength is also demonstrated in FIG. 2, where comparison of the diagonally hatched bands with the vertically hatched bands shows the effect of Mn addition to a 6% Zn alloy with varying copper content.

It may also be seen from Table 3 that the improvements in Yield strength were obtained in alloys with Mn additions which had not been subjected to a specific grain refining process, and also in an alloy which had been subjected to the same grain refining process as the non-Mn containing alloys (alloy 22). This again indicates that a grain refining step is not necessary for alloys in the compositional range of the invention to develop attractive tensile properties.

EXAMPLE 4

The procedure of Example 1 was followed, but varying amounts of additional alloying elements were added to alloys containing Mg, Zn, Cu, or Mg, Zn, Cu, Mn, as shown in Table 4. From the data shown, the following conclusions can be drawn.

(1) The presence of Al, even at levels as low as 0.5% is undesirable, as it:
   (a) Reduced U.T.S. and ductility in the as-cast state.
   (b) Significantly reduced the solidus temperature of the alloy, prohibiting the application of a high temperature solution treatment, resulting in poor heat treated properties.

(2) Addition of Ce/La rich rare earth mixture has little effect on Yield strength of the alloy either as cast or heat treated, and although causing some loss of U.T.S. and ductility could be tolerated at low levels where specific effects (e.g. improved creep resistance) were required. Nd rich rare earth has less effect on properties and is a preferable Rare earth addition.

(3) Additions of up to 1% Sn, and 0.5% Sb have little effect on tensile properties, and could be added where specific effects (e.g. improved castability or corrosion resistance) were required.

(4) Additions of bismuth up to 1% or cadmium to 2% can increase the Yield strength of the Mn containing alloy, and would be beneficial additives.

(5) Addition of silicon appears to reduce the Yield strength of the alloy at the 0.2% level, and where the element may be desirable for example, to improve elevated temperature creep properties, it would be limited to low levels.

EXAMPLE 5

In order to test the corrosion resistance of alloys according to the invention alloys having the compositions given in Table 5 below were made and heat-treated as in Example 1. The corrosion resistance of samples, as-cast and heat treated, was estimated by immersing them in 3% by weight aqueous solution of sodium chloride, saturated with magnesium hydroxide, at room temperature for 28 days and measuring the weight loss per unit area. The results are quoted in Table 5 as proportions of the weight loss for the 6% Zn, 2% Cu alloy as-cast, which is taken as 100.

It will be noted from Table 5 that:

(1) For all alloys within the range of Zn and Cu according to the invention, corrosion rates after heat treatment were significantly lower than in the as-cast state, in contrast to the comparative alloy AZ91, for which corrosion rate was higher after heat treatment.

(2) Addition of Mn to Mg-Zn-Cu alloys in the heat-treated condition produced a significant reduction in corrosion rate.

(3) Additions of Bi or Cd to Mg-Zn-Cu-Mn alloys produced further reductions in corrosion rate compared to alloys without additions.

(4) By contrast, addition of Al to a Mg-Zn-Cu-Mn alloy, although reducing the corrosion rate in the as-cast condition, significantly increased the corrosion rate after heat treatment.

(5) Addition of Sb to a Mg-Zn-Cu alloy reduced the corrosion rate in the as-cast state.

EXAMPLE 6

In order to test the microporosity of castings, the alloys given in Table 6 below were sand cast to give unchilled plates having a thickness of 2.5 cm using short risers to exaggerate the porosity of the castings. The percentage area of the castings affected by porosity, the areas of worst porosity and the porosity rating, assessed according to the ASTM standard reference radiographs for micro-shrinkage, were measured and a "porosity factor", obtained by multiplying the area of worst porosity by the worst porosity rating, was deduced. The results are given in Table 6 below.

These results indicate that least porosity is obtained with zinc contents around 6%. Alloys containing no copper showed worse porosity than those with copper additions, and reduction in porosity occurred with increasing copper content.

At the 2% Cu level porosity was further improved by Mn addition. Additions of Sn, Nd or Bi had little significant deleterious effect on porosity, and could be tolerated if added for other purposes.

EXAMPLE 7

As a further test of freedom from porosity in casting, a number of Mg-Zn-Cu-Mn alloys were melted and alloyed by conventional techniques, without any specific grain refining step. Alloys were then sand cast using a bottom running technique to produce a standard open ended rectangular box shaped test casting known as "Spitaler Box", as described in Transactions of the American Foundry Society 1967. Vol. 75 pp 17–20.

A similar casting was also made using the identical casting technique in the comparative alloy AZ91. In this case the melt was grain refined by plunging hexachlorethane into the melt, which is an accepted grain refinement technique for AZ91.

After fettling, boxes were clamped between flat plates with gaskets, filled with water, pressurized internally to 50 psi and held at that pressure for 10 minutes. Any leakage of water through the walls of the casting due to the presence of porosity was observed.

Results were as shown in Table 7 below.

EXAMPLE 8

In order to confirm that the grain refining effect of copper would not deteriorate with repeated recycling of material, as would occur under practical foundry conditions, a test was carried out in which 27 kg scale melts were made in a number of Mg-Zn-Cu-Mn alloys. Melts were made using conventional melting practice as described in previous examples. For the first melt, virgin materials were used. Spitaler box castings as described in Example 7 were sand cast, along with a number of standard sand cast test bars. Test bars were retained from the cast, and heat treated and tested as described in Examples 1 and 2. After examination of the test box castings, the castings and associated scrap from runners etc. were recycled into a second melt, so that the second melt was composed of 75% scrap, 25% virgin material. This process was repeated three times, retaining test bars from each melt. After the final melt, test pieces were cut from the spitaler box test castings, heat treated, and machined to tensile specimens and tested in comparison with standard cast test bars from the same melt. Results are shown in Table 8.

These results show that:

(1) Recycling of material without any specific grain refining process has no significant effect on the tensile properties of the alloy and that the attractive heat treated properties are maintained.

(2) There is little difference between the properties obtained within the casting, and those obtained on standard test bars taken from the same melt.

EXAMPLE 9

It is known that when welding magnesium alloy castings, some magnesium alloys with a high Zn content are prone to cracking. One such alloy is known as Z5Z (Mg-4.5% Zn-0.7% Zr). Weld tests were carried out on plates cast from an alloy containing nominally 6% Zn, 2½% Cu, ½% Mn in comparison with the alloy Z5Z, using the following parameters:

(1) Thickness of material 6 mm.

(2) Size of plate 165 mm × 125 mm.

(3) Argon-arc welding current 135 A.

(4) Electrode size 3 mm with 9 mm ceramic gas nozzle.

(5) Time to weld 30 seconds.

Severe cracking was observed in the Z5Z plate, while no cracking was evident in the Mg-Zn-Cu-Mn plate, indicating the beneficial effect of copper on the weldability of the alloy.

TABLE 1

| Alloy No. | Analysis % Zn | Analysis % Cu | Tensile Properties (As cast N/mm²) Y.S. | U.T.S. | E % | Solidus Temp. °C. | Solution Treat Temp. °C. | Tensile Properties (Heat Treated N/mm²) Y.S. | U.T.S. | E % | Grain Size mm |
|---|---|---|---|---|---|---|---|---|---|---|---|
| A | 4.1 | — | 42 | 154 | 5½ | 343 | 330 | 89 | 174 | 4 | 0.208 |
| B | 6.0 | | 48 | 152 | 4 | 343 | 330 | 115 | 201 | 3 | 0.199 |
| C | 8.5 | | 61 | 126 | 3 | 343 | 330 | 137 | 180 | 2 | ND |
| D | 10.4 | | 61 | 108 | 3 | 343 | 330 | 134 | 160 | 1 | 0.122 |
| E | 3.9 | 0.22 | 52 | 139 | 5½ | ND | 330 | 83 | 133 | 2 | ND |
| 1 | 2.1 | 0.85 | 38 | 160 | 7½ | 450–460 | 435 | 62 | 186 | 9½ | 0.194 |
| 2 | 4.0 | 0.55 | 55 | 165 | 8 | ND | 330 | 72 | 168 | 6 | ND |
| 3 | 4.4 | 0.96 | 50 | 194 | 11 | 450–460 | 435 | 104 | 234 | 11 | 0.175 |
| 4 | 6.0 | 0.95 | 56 | 163 | 6 | 430–440 | 420 | 135 | 224 | 4 | 0.195 |
| 5 | 6.0 | 2.02 | 55 | 192 | 8½ | 450–460 | 435 | 119 | 233 | 7½ | 0.164 |
| 6 | 6.4 | 0.94 | 59 | 185 | 7½ | 430–440 | 420 | 146 | 262 | 7 | 0.135 |
| 7 | 6.4 | 1.46 | 66 | 205 | 10 | 450–460 | 435 | 144 | 263 | 9 | 0.120 |
| 8 | 6.4 | 2.13 | 63 | 199 | 9 | 450–455 | 430 | 136 | 253 | 9½ | 0.100 |
| 9 | 6.4 | 2.62 | 69 | 209 | 10½ | 450–455 | 430 | 124 | 251 | 13 | 0.071 |
| 10 | 6.5 | 3.16 | 62 | 199 | 9½ | 460–465 | 435 | 109 | 230 | 10½ | 0.103 |
| 11 | 6.3 | 3.64 | 84 | 203 | 9 | 465–470 | 435 | 97 | 229 | 11 | 0.077 |
| 12 | 8.1 | 1.01 | 69 | 191 | 7½ | 390–395 | 370 | 147 | 236 | 4 | 0.099 |
| 13 | 8.1 | 2.06 | 65 | 188 | 7 | 430–440 | 410 | 165 | 262 | 6 | ND |
| 14 | 10.0 | 0.99 | 61 | 162 | 5 | 340–350 | 325 | 123 | 205 | 2½ | 0.161* |
| 15 | 10.0 | 1.57 | 71 | 164 | 4½ | 370–375 | 355 | 144 | 214 | 2 | 0.132 |
| 16 | 9.8 | 2.04 | 72 | 178 | 6 | 410–430 | 395 | 163 | 243 | 3 | 0.095 |
| 17 | 10.3 | 2.67 | 81 | 187 | 5 | 410–415 | 390 | 167 | 230 | 2 | 0.153 |
| AZ91 Specn. Minima | | | 95 | 125 | 2 | | | 120 | 200 | 2 | |

*No specific grain refinement process used.
N.D. = Not measured.

TABLE 2

| Alloy No. | ANALYSIS % Zn | Cu | X | HEAT TREATMENT | TENSILE PROPERTIES (N/mm²) Y.S. | U.T.S. | % El. |
|---|---|---|---|---|---|---|---|
| 18 | 6.4 | 2.11 | — | AS CAST | — | — | — |
| | | | | 8 hrs @ 435° C., HWQ. | 61 | 205 | 9½ |
| | | | | 8 hrs @ 435° C., HWQ, 24 hrs @ 180° C. | 126 | 242 | 8 |
| 19 | 6.2 | 2.04 | 0.48 Mn | AS CAST | — | — | — |
| | | | | 8 hrs @ 435° C., HWQ | 64 | 202 | 9½ |
| | | | | 8 hrs @ 435° C., HWQ, 24 hrs @ 180° C. | 137 | 232 | 5½ |
| 20 | 6.5 | 2.11 | (0.5 Sb) | AS CAST | — | — | — |
| | | | | 8 hrs @ 435° C., HWQ. | 58 | 211 | 11½ |
| | | | | 8 hrs @ 435° C., HWQ, 24 hrs @ 180° C. | 128 | 234 | 7½ |
| 21 | 6.6 | 0.82 | — | AS CAST | 39 | 172 | 7½ |
| | | | | 24 hrs @ 250° C. AIR COOL. | 65 | 172 | 6 |
| | | | | 8 hrs @ 330° C., HWQ, 24 hrs @ 180° C. | 95 | 187 | 5½ |
| | | | | 8 hrs @ 410° C., HWQ, 24 hrs @ 180° C. | 142 | 235 | 5½ |
| 22 | 6.6 | 1.14 | — | AS CAST | 54 | 166 | 7 |
| | | | | 24 hrs @ 250° C. AIR COOL. | 57 | 164 | 6 |
| | | | | 8 hrs @ 330° C., HWQ, 24 hrs @ 180° C. | 89 | 197 | 5 |
| | | | | 8 hrs @ 425° C., HWQ, 24 hrs @ 180° C. | 140 | 240 | 5½ |
| 23 | 8.2 | 1.0 | — | AS CAST | 62 | 156 | 5 |
| | | | | 24 hrs @ 250° C. AIR COOL. | 70 | 188 | 4 |
| | | | | 8 hrs @ 330° C., HWQ, 24 hrs @ 180° C. | 120 | 195 | 3 |
| | | | | 8 hrs @ 380° C., HWQ, 24 hrs @ 180° C. | 155 | 231 | 2 |
| 24 | 7.9 | (1.0) | (1.0 Sn) | AS CAST | 65 | 151 | 5½ |
| | | | | 24 hrs @ 250° C. AIR COOL. | 75 | 160 | 4 |
| | | | | 8 hrs @ 330° C., HWQ, 24 hrs @ 180° C. | 121 | 190 | 2½ |
| | | | | 8 hrs @ 380° C., HWQ, 24 hrs @ 180° C. | 143 | 215 | 1 |
| 7 | 6.4 | 1.46 | — | AS CAST | 66 | 205 | 10 |
| | | | | 24 hrs @ 250° C. AIR COOL. | 67 | 200 | 9 |
| | | | | 8 hrs @ 435° C., HWQ, 24 hrs @ 180° C. | 144 | 263 | 9 |
| 25 | 10.3 | 1.04 | — | AS CAST | 63 | 162 | 4½ |
| | | | | 24 hrs @ 250° C. AIR COOL. | 70 | 165 | 4 |
| | | | | 8 hrs @ 320° C., HWQ, 24 hrs @ 180° C. | 122 | 203 | 2 |

HWQ = Hot water quench

TABLE 3

| Alloy No. | Analysis % Zn | Cu | Mn | Solution Treat Temperature (°C.) | Tensile Properties (Heat Treated) N/mm² Y.S. | U.T.S. | E % | Grain Refiner |
|---|---|---|---|---|---|---|---|---|
| 4 | 6.0 | 0.95 | — | 420 | 135 | 224 | 4 | Zn/Fe Hardener alloy |
| 26 | 6.1 | 1.07 | 0.78 | 420 | 161 | 237 | 2½ | $FeCl_3$ |

TABLE 3-continued

| Alloy No. | Analysis % Zn | Cu | Mn | Solution Treat Temperature (°C.) | Tensile Properties (Heat Treated) N/mm² Y.S. | U.T.S. | E % | Grain Refiner |
|---|---|---|---|---|---|---|---|---|
| 7 | 6.4 | 1.46 | — | 435 | 144 | 263 | 9 | $FeCl_3$ |
| 27 | 6.1 | 1.49 | 0.44 | 435 | 172 | 244 | 4 | None |
| 5 | 6.0 | 2.0 | — | 435 | 119 | 233 | 7½ | $FeCl_3$ |
| 28 | 6.1 | 2.2 | 0.47 | 435 | 159 | 239 | 4 | None |

TABLE 3-continued

| Alloy No. | Analysis % Zn | Cu | Mn | Solution Treat Temperature (°C.) | Tensile Properties (Heat Treated) N/mm² Y.S. | U.T.S. | E % | Grain Refiner |
|---|---|---|---|---|---|---|---|---|
| 29 | 6.1 | 2.1 | 0.89 | 435 | 163 | 238 | 3 | None |
| 9 | 6.4 | 2.62 | — | 430 | 124 | 251 | 13 | $FeCl_3$ |
| 30 | 6.2 | 2.6 | 0.24 | 435 | 131 | 222 | 5 | None |
| 31 | 6.2 | 2.7 | 0.93 | 435 | 155 | 248 | 5 | None |
| 10 | 6.5 | 3.2 | — | 435 | 109 | 230 | 10½ | $FeCl_3$ |
| 32 | 6.7 | 2.9 | 0.47 | 435 | 147 | 230 | 5 | None |
| 11 | 6.3 | 3.6 | — | 435 | 97 | 229 | 11 | $FeCl_3$ |
| 33 | 6.6 | 3.3 | 0.43 | 435 | 135 | 217 | 4 | None |

TABLE 5-continued

| Alloy No. | Analysis % Zn | Cu | Mn | X | Corrosion Rate* As Cast | Heat Treated |
|---|---|---|---|---|---|---|
| 54 | 6.0 | 2.1 | 0.25 | — | 88 | 19 |
| 19 | 6.2 | 2.04 | 0.48 | — | 127 | 14 |
| 29 | 6.1 | 2.1 | 0.89 | — | 71 | 22 |
| 42 | 6.2 | 2.6 | 0.48 | — | 141 | 24 |
| 47 | 6.0 | 2.7 | 0.47 | (0.5) Bi | 128 | 13 |
| 48 | 6.1 | 2.8 | 0.49 | (1.0) Bi | 152 | 12 |
| 45 | 6.1 | 2.5 | 0.47 | 0.54 Al | 53 | 99 |
| 52 | 6.0 | 2.7 | 0.49 | 1.5 Cd | 83 | 14 |
| F | Comparative AZ91 alloy | | | | 72 | 90 |
| G | Comparative AZ91 alloy | | | | 80 | 142 |

*Corrosion Rate - expressed relative to that for an alloy containing 6% Zn, 2% Cu, (Alloy No. 18) which is expressed as 100.
Analyses in brackets indicate nominal values.

TABLE 4

| Alloy No. | Analysis % Zn | Cu | Mn | X | Tensile Properties (As Cast) N/mm² Y.S. | U.T.S. | E % | Solidus Temperature °C. | Solution Treat Temperature °C. | Tensile Properties (Heat Treated) N/mm² Y.S. | U.T.S. | E % | Grain Size (mm) |
|---|---|---|---|---|---|---|---|---|---|---|---|---|---|
| 6 | 6.4 | 0.94 | — | — | 59 | 185 | 7½ | 430–440 | 420 | 146 | 262 | 7 | 0.135 |
| 34 | 5.7 | 0.76 | — | 0.18 Ce | 34 | 123 | 4½ | 430 | 410 | 144 | 183 | 1½ | 0.196 |
| 35 | 6.4 | 1.04 | — | (0.5) Nd | 55 | 165 | 6½ | 430–440 | 420 | 140 | 223 | 4 | 0.139 |
| 36 | 6.2 | 0.92 | — | 0.97 Al | 58 | 166 | 6 | 330–340 | 320 | 88 | 180 | 4 | 0.201 |
| 37 | 6.3 | 1.06 | — | 1.07 Al | 58 | 145 | 4 | 330–340 | 320 | 85 | 154 | 2½ | 0.236 |
| 26 | 6.1 | 1.07 | 0.78 | — | 55 | 159 | 5 | 440–450 | 420 | 161 | 237 | 2½ | 0.148 |
| 8 | 6.4 | 2.13 | — | — | 63 | 199 | 9 | 450–455 | 430 | 136 | 253 | 9½ | 0.100 |
| 38 | (6.0) | (2.0) | — | (1.0) Sn | 63 | 190 | 8 | 450–455 | 435 | 129 | 250 | 9 | ND |
| 39 | 6.5 | 2.11 | — | (0.5) Sb | — | — | — | 450–455 | 435 | 128 | 234 | 7½ | 0.141 |
| 40 | 6.2 | 2.22 | — | (1.0) Bi | 61 | 168 | 6 | 450–455 | 435 | 127 | 216 | 4½ | 0.129 |
| 41 | 6.2 | 2.2 | — | 0.03 Si | 68 | 156 | 6 | 450–455 | — | — | — | — | 0.140 |
| 28 | 6.1 | 2.2 | 0.47 | — | 75 | 178 | 7 | 450–455 | 435 | 159 | 239 | 4 | ND |
| 9 | 6.4 | 2.62 | — | — | 69 | 209 | 10½ | 450–455 | 430 | 124 | 251 | 13 | 0.071 |
| 42 | 6.2 | 2.6 | 0.48 | — | 74 | 171 | 6 | 450–455 | 435 | 148 | 226 | 3 | ND |
| 43 | 5.9 | 2.6 | 0.47 | (0.25) Ce | 73 | 145 | 3½ | 450–455 | 435 | 148 | 201 | 1 | ND |
| 44 | 6.1 | 2.7 | 0.47 | (0.5) Ce | 76 | 129 | 3 | 450–455 | 435 | 141 | 189 | 1 | ND |
| 45 | 6.1 | 2.5 | 0.47 | 0.54 Al | 75 | 133 | 3 | 340–350 | 330 | 90 | 139 | 1½ | ND |
| 46 | 5.8 | 2.6 | 0.47 | 4.0 Al | 92 | 149 | 3 | 340–350 | 330 | 112 | 174 | 2 | ND |
| 47 | 6.0 | 2.7 | 0.47 | (0.5) Bi | 76 | 187 | 7½ | 450–455 | 435 | 152 | 236 | 4 | ND |
| 48 | 6.1 | 2.8 | 0.49 | (1.0) Bi | 73 | 156 | 5 | 450–455 | 435 | 153 | 217 | 2 | ND |
| 49 | 6.3 | 2.6 | 0.48 | (0.75) Bi | — | — | — | 450–455 | 435 | 164 | 229 | 3 | ND |
| 50 | 6.2 | 2.7 | 0.43 | 0.2 Si | 76 | 172 | 5½ | 450–455 | 435 | 120 | 212 | 5 | ND |
| 51 | 6.1 | 2.6 | 0.39 | 0.17 Si | — | — | — | 450–455 | 435 | 126 | 210 | 4 | ND |
| 52 | 6.0 | 2.7 | 0.49 | (1.5) Cd | 76 | 175 | 6 | 450–455 | 435 | 142 | 217 | 3 | ND |
| 53 | 6.2 | 2.6 | 0.47 | (2.0) Cd | — | — | — | 450–455 | 435 | 160 | 246 | 4½ | ND |

Analyses in brackets indicate nominal values.

TABLE 5

| Alloy No. | Analysis % Zn | Cu | Mn | X | Corrosion Rate* As Cast | Heat Treated |
|---|---|---|---|---|---|---|
| 18 | 6.4 | 2.11 | — | — | 100 | 38 |
| 20 | 6.5 | 2.11 | — | (0.5) Sb | 87 | 41 |

TABLE 6

| Alloy No. | Analysis % Zn | Cu | Mn | X | Radiographic Assessment: Area Affected By Porosity % | Area of Worst Porosity % | Rating of Worst Porosity* | Porosity Factor** |
|---|---|---|---|---|---|---|---|---|
| H | 9.5 | | — | — | 95 | 75 | 7 | 525 |
| 55 | 9.2 | 1.08 | — | — | 90 | 60 | 8 | 480 |
| 56 | 9.5 | 1.10 | — | (1.0) Sn | 90 | 60 | 8 | 480 |
| 57 | 8.1 | 1.54 | — | — | 60 | 30 | 8 | 240 |
| 58 | 8.1 | 2.06 | — | — | 90 | 20 | 8+ | 160–240 |
| 59 | 6.3 | 1.54 | — | — | 90 | 40 | 8 | 320 |
| 8 | 6.4 | 2.13 | — | — | 40 | 10 | 7 | 70 |
| 9 | 6.4 | 2.62 | — | — | 20 | 10 | 7 | 70 |
| 60 | 6.1 | 0.97 | 0.48 | — | 75 | 50 | 8 | 400 |
| 61 | 6.3 | 2.04 | 0.47 | — | 30 | 10 | 6 | 60 |
| 62 | 6.1 | 2.1 | — | 0.14 Nd | 40 | 30 | 8 | 240 |
| 40 | 6.2 | 2.22 | — | (1.0) Bi | 40 | 15 | 7 | 105 |
| J | AZ91 Comparative Alloy | | | | 75 | 60 | 5 | 300 |

*Porosity Rating based on A.S.T.M. Standard Reference radiograph for Microshrinkage (Sponge type) 2.32. ¾" plate.
**Porosity Factor = area of worst porosity × rating of worst porosity.
Analyses in brackets indicate nominal compositions.

TABLE 7

| Alloy No. | Analysis Zn | Cu | Mn | Result of Pressure Test |
|---|---|---|---|---|
| K | AZ91 comparative alloy. | | | Gross leakage from large areas around top corners. |
| 63 | 6.2 | 2.46 | 0.47 | 1 point of leakage near top corner - oozing only. |
| 32 | 6.7 | 2.9 | 0.47 | 1 point of leakage near top corner - oozing only. |
| 64 | 6.4 | 2.4 | 0.47 | No leaks. |
| 33 | 6.6 | 3.3 | 0.43 | No leaks. |

TABLE 8

| MELT CYCLE | | Analysis % Zn | Cu | Mn | Tensile Properties (Test Bars) As Cast (N/mm²) Y.S. | U.T.S. | E % | Heat Treated (N/mm²) Y.S. | U.T.S. | E % | Tensile Props (From Casting) Heat Treated (N/mm²) Y.S. | U.T.S. | E % |
|---|---|---|---|---|---|---|---|---|---|---|---|---|---|
| TEST 1 | Virgin Melt | 6.0 | 2.4 | 0.44 | 71 | 178 | 8 | 145 | 222 | 4 | — | — | — |
| | 1st Recycle | 6.1 | 2.4 | 0.47 | 74 | 182 | 7 | 147 | 229 | 5 | — | — | — |
| | 2nd Recycle | 6.4 | 2.4 | 0.47 | 72 | 177 | 7 | 150 | 227 | 5 | — | — | — |
| | 3rd Recycle | 6.4 | 2.4 | 0.44 | 73 | 178 | 7 | 148 | 222 | 4 | 148 | 219 | 4 |
| TEST 2 | Virgin Melt | 6.7 | 2.9 | 0.47 | 73 | 166 | 5 | 147 | 230 | 5 | — | — | — |
| | 1st Recycle | 7.1 | 2.8 | 0.44 | 75 | 196 | 9 | 158 | 247 | 5 | — | — | — |
| | 2nd Recycle | 7.0 | 2.7 | 0.44 | 73 | 175 | 6 | 156 | 233 | 4 | — | — | — |
| | 3rd Recycle | 7.0 | 2.9 | 0.43 | 76 | 183 | 7 | 154 | 228 | 4 | 150 | 218 | 3½ |

We claim:

1. A magnesium alloy consisting essentially of the following constituents by weight (apart from impurities):

Zinc: 2–10%

Copper: 0.5–5%

Magnesium: Remainder aluminum being absent.

2. An alloy according to claim 1, containing from 5 to 7% of zinc and from 1 to 3.5% of copper.

3. An alloy according to claim 1, which further contains up to 2% of manganese.

4. An alloy according to claim 1, which further contains at least one of the following constituents: up to 3% of bismuth, up to 1% of antimony, up to 2% of tin, up to 5% of cadmium, up to 1% of silicon and up to 1% of rare earth metals.

5. A cast magnesium article, composed of an alloy according to claim 1.

6. An alloy according to claim 3, which contains from 0.2 to 1% of manganese.

7. An article according to claim 5, which has been solution treated for from 2 to 8 hours at a temperature from 5° to 40° C. below the solidus temperature of the alloy, quenched and aged at a temperature from 120° to 250° C. for at least 2 hours.

8. An article according to claim 5 containing from 2 to 3% copper and about 6% zinc.

9. A sand-cast article according to claim 5.

* * * * *